US012790796B2

(12) United States Patent
Gebert et al.

(10) Patent No.: US 12,790,796 B2
(45) Date of Patent: Nov. 10, 2026

(54) COLD WATER COOLING WITH HEAT RECOVERY

(71) Applicant: Georg Fischer JRG AG, Sissach (CH)

(72) Inventors: Steffen Gebert, Uhlstädt-Kirchhasel (DE); Simon Obrist, Zollikon (CH); Hartmann Schiefer, Weinstadt-Beutelsbach (DE); Michael Bauer, Elsteraue (DE); Benedikt Kemler, Münster (DE); Rustam Balasoltanov, Leipzig (DE); Daniel Michel, Mömbris (DE)

(73) Assignee: Georg Fischer JRG AG, Sissach (CH)

( * ) Notice: Subject to any disclaimer, the term of this patent is extended or adjusted under 35 U.S.C. 154(b) by 41 days.

(21) Appl. No.: 18/961,540

(22) Filed: Nov. 27, 2024

(65) Prior Publication Data

US 2025/0171985 A1 May 29, 2025

(30) Foreign Application Priority Data

Nov. 28, 2023 (EP) ..... 23212596

(51) Int. Cl.
*E03B 7/04* (2006.01)
*E03B 1/02* (2006.01)
(Continued)

(52) U.S. Cl.
CPC ..... *E03B 7/078* (2013.01); *E03B 1/02* (2013.01); *E03B 7/02* (2013.01); *E03B 7/04* (2013.01);
(Continued)

(58) Field of Classification Search
CPC .... E03C 1/00; F24D 17/0005; F24D 19/1054; F24D 17/0078; F24D 17/02;
(Continued)

(56) References Cited

U.S. PATENT DOCUMENTS 8,011,536 B2 * 9/2011 Witschke ..... F24D 17/0078 165/184
8,302,675 B2 * 11/2012 Bull ..... F24D 17/02 165/286
(Continued)

FOREIGN PATENT DOCUMENTS

EP 2966384 A1 1/2016
EP 3037591 B1 8/2017
(Continued)

*Primary Examiner* — Craig M Schneider
*Assistant Examiner* — Christopher D Ballman
(74) *Attorney, Agent, or Firm* — Harness, Dickey & Pierce, P.L.C.

(57) ABSTRACT

A drinking water supply system with circulation cooling includes a pump for producing a volumetric flow rate in a cold water circuit in the cold water line system, and at least one cold water return line and also a refrigeration unit, wherein the drinking water supply system comprises a primary low-temperature loop and a secondary high-temperature loop, wherein the refrigeration unit is connected to the primary low-temperature loop and the secondary high-temperature loop, wherein arranged in the cold water line system for cooling of the cold water is a heat exchanger which withdraws heat energy from the cold water and is coupled to the refrigeration unit such that the heat exchanger releases or transfers the heat energy of the cold water to the refrigeration unit by means of the primary low-temperature loop and the refrigeration unit makes the withdrawn heat energy available to the high-temperature loop.

14 Claims, 2 Drawing Sheets

(51) Int. Cl.

| | |
|---|---|
| ***E03B 7/02*** | (2006.01) |
| ***E03B 7/07*** | (2006.01) |
| ***F24D 17/00*** | (2022.01) |
| ***F24D 19/10*** | (2006.01) |
| *E03C 1/00* | (2006.01) |
| *F24D 17/02* | (2006.01) |
| *F24H 15/14* | (2022.01) |
| *F24H 15/212* | (2022.01) |
| *F24H 15/31* | (2022.01) |
| *F24H 15/34* | (2022.01) |

(52) U.S. Cl.
CPC ..... *E03B 7/075* (2013.01); *F24D 17/0005* (2013.01); *F24D 19/1054* (2013.01); *E03C 1/00* (2013.01); *F24D 17/0078* (2013.01); *F24D 17/02* (2013.01); *F24H 15/14* (2022.01); *F24H 15/212* (2022.01); *F24H 15/31* (2022.01); *F24H 15/34* (2022.01)

(58) Field of Classification Search
CPC ..... F24H 15/212; F24H 15/34; F24H 15/14; F24H 15/31; E03B 7/04
See application file for complete search history.

(56) References Cited

U.S. PATENT DOCUMENTS

| | | | | |
|---|---|---|---|---|
| 8,651,331 | B2 * | 2/2014 | Krause | F25D 23/126 222/129 |
| 9,139,415 | B2 * | 9/2015 | Hall | F25D 23/04 |
| 10,323,859 | B2 * | 6/2019 | Alsadah | F24H 15/223 |
| 11,408,615 | B2 * | 8/2022 | Kato | F24D 17/0005 |
| 11,466,870 | B1 * | 10/2022 | Shahsavar | F24D 17/0005 |
| 2012/0211085 | A1 | 8/2012 | Abbing | |
| 2016/0311702 | A1 * | 10/2016 | Hartig | B01D 61/22 |
| 2020/0056791 | A1 * | 2/2020 | Collins | G05D 23/132 |
| 2020/0056846 | A1 * | 2/2020 | Olofsson | F24D 11/02 |
| 2020/0340663 | A1 * | 10/2020 | Fotinos | F24D 17/0005 |
| 2021/0148614 | A1 * | 5/2021 | Melink | F24D 17/0005 |
| 2022/0205647 | A1 | 6/2022 | Bawey et al. | |

FOREIGN PATENT DOCUMENTS

| | | | |
|---|---|---|---|
| EP | 3705789 | B1 | 5/2023 |
| WO | 2011071369 | A1 | 6/2011 |
| WO | 2020228921 | A1 | 11/2020 |

* cited by examiner

COLD WATER COOLING WITH HEAT RECOVERY

CROSS-REFERENCE TO RELATED APPLICATIONS

This application claims the benefit and priority of European Application No. 23212596.3 filed Nov. 28, 2023. The entire disclosure of the above application is incorporated herein by reference.

BACKGROUND OF THE INVENTION

Technical Field

The invention relates to a drinking water supply system with circulation cooling and to a method for operating such a system, comprising a cold water line system with at least one consumer arranged thereon, a connection to a public water supply network, a pump for producing a volumetric flow rate in a cold water circuit in the cold water line system, and at least one cold water return line and also a refrigeration unit.

Discussion

In some buildings, owing to internal and external thermal loads, the maintenance of drinking water hygiene and comfort needs, and the associated need to maintain temperatures in accordance with current national directives/laws in cold water systems for cold water, requires that said temperatures, for example ≤25° C., be ensured by means of active cooling.

EP 3 037 591 B1 discloses a cold water circulation intended to ensure that the cold water in the cold water supply system does not exceed a predetermined temperature. Analogously to a hot water circulation system, cold water heated to an excessively high level because of heat absorption by the pipe system is provided for cooling via a cold water circulation line, and in the case of multiple circulation lines the volumetric flow rate is usually controlled by circulation control valves.

EP 3 705 789 A1 discloses a water supply system for a building that uses a heat pump to directly transfer the energy from the cold water to the hot water.

It is an aspect of the invention to propose a drinking water supply system and a method for operating such a system that sustainably withdraws the excess and unwanted heat energy from the cold water network and supplies it to other heating systems for building use/building heating.

SUMMARY

According to the invention, this aspect is achieved in that the drinking water supply system comprises a primary low-temperature loop and a secondary high-temperature loop, wherein the refrigeration unit is connected to the primary low-temperature loop and the secondary high-temperature loop, wherein arranged in the cold water line system for cooling of the cold water is a heat exchanger which withdraws heat energy from the cold water and is coupled to the refrigeration unit such that the heat exchanger releases or transfers the heat energy of the cold water to the refrigeration unit by means of the primary low-temperature loop and the refrigeration unit makes the withdrawn heat energy available to the high-temperature loop.

The drinking water supply system of the invention with circulation cooling for a building comprises a cold water line system with at least one consumer arranged thereon. The cold water line system preferably comprises a feed line which brings the cold water to the consumer and at least one return line which returns unused cold water. Preferably, the feed line branches off from a main feed line to a consumer and the return line connects to a main return line. It is advantageous if each consumer has a separate feed line and return line which branches off from a main line or connects to a main line. The drinking water supply system of the invention also comprises a connection to a public water supply network. It is advantageous if the connection connects to the main feed line or to the main return line and the fresh cold water is fed through it. A pump for producing a volumetric flow rate in a cold water circuit is arranged in the cold water line system. The drinking water supply system of the invention moreover comprises a refrigeration unit. The drinking water supply system also comprises a primary low-temperature loop and a secondary high-temperature loop. The refrigeration unit is coupled or connected to the primary low-temperature loop and the secondary high-temperature loop, or the medium of the two circuits flows through the refrigeration device, with the two loops being separate circuits. The drinking water supply system of the invention comprises a heat exchanger which withdraws heat energy from the cold water and is coupled to the refrigeration unit such that the heat exchanger releases or transfers the heat energy of the cold water to the refrigeration unit and the refrigeration unit makes the withdrawn heat energy available to the high-temperature loop.

It is advantageous if the cold water is passed to the heat exchanger via a return line, wherein the heat exchanger cools the cold water to a hygienically optimal temperature and brings it back into the cold water line system. Preferably, a hygienically optimal temperature is below 20/25° C.; this can avoid multiplication of waterborne microorganisms such as *Legionella* in the cold water and their negative impact on use of the cold water.

It is advantageous if the pump controls the volumetric flow rate in the cold water circuit variably depending on temperature or differential pressure. As a result of the volumetric flow rate produced, the cold water temperature is accordingly rapidly reduced or brought to the predefined temperature.

In the case of multiple cold water return lines, it has been shown to be advantageous if circulation valves for balancing of the cold water line system are temperature-controlled valves. The circulation valves are preferably each arranged in the return lines. Preferably, the circulation valves are arranged downstream of the last consumer in the direction of flow. Preferably, the circulation valve ensures a constant minimum volumetric flow rate that prevents stagnation in the cold water line system. When using at least one temperature-controlled circulation valve, it is advantageous if a differential pressure-controlled pump is used and autonomously adapts the volumetric flow rate in the cold water circuit to the control behaviour of the circulation valve. That is to say, if the return line of the cold water has a relatively high temperature, the circulation valve opens more greatly and the pump increases the volumetric flow rate in order to pass the heated cold water through the heat exchanger as rapidly as possible and to withdraw the heat so that the cold water downstream of the heat exchanger has the desired temperature.

Preferably, the refrigeration unit transfers the heat energy to a heat store. Preferably, the heat store serves to support heat generation for heating or building and room heating, for water heating, for heat generation for process applications and/or for heat generation for ventilation and air-conditioning systems.

It has been shown to be a preferred configuration if the refrigeration unit comprises a pump for the primary low-temperature loop. Variable speed control of the pump in the low-temperature loop achieves a variable volumetric flow rate by means of which the desired temperature in the cold water is achieved.

Preferably, the refrigeration unit comprises a pump for the secondary high-temperature loop. The energy carrier medium preferably used in the secondary high-temperature loop is treated heating water. Moreover, it has been shown to be advantageous that the pump is speed-controlled and the volumetric flow rate can thereby be controlled accordingly, which has an influence on the use temperature in the high-temperature loop, this in turn having an influence on the heat energy which is passed to the heat store.

It has been shown to be advantageous if the refrigeration unit comprises an evaporator, a compressor, a condenser and an expansion valve for energy transfer between low-temperature loop and high-temperature loop. The refrigerant in the refrigeration circuit of the refrigeration unit withdraws energy from the low-temperature loop by evaporation in the evaporator, and the refrigerant is then compressed by the compressor and brought to a temperature level usable for the high-temperature loop. This energy is then released to the high-temperature loop in the condenser and supplied to the heat store, and the refrigerant condenses. The liquefied refrigerant then flows back, through the expansion valve, into the evaporator, where the heat from the low-temperature loop is supplied to the refrigerant again to make the refrigerant evaporate once more, and the circuit starts over.

As a preferred embodiment, a flush valve is integrated in the cold water circulation system, wherein the flush valve serves to ensure proper water exchange. It has been shown to be advantageous if the flush valve is located centrally. Moreover, it is advantageous if the flush valve is electronic.

It is advantageous if the connection to a public water supply network connects to the main feed line or to the main return line and the fresh cold water is fed through it. If the temperature level of the cold water from the water supply network is elevated, it may be quite appropriate for the water supply network connection to connect to the return line in the cold water line system, i.e. even before the heat exchanger and before the cold water reaches the consumer. As a result, the newly supplied cold water is also brought to a lower temperature level before it reaches the consumers.

The method of the invention for operating a drinking water supply system having the above-mentioned elements is distinguished in that the heat energy withdrawn from the cold water by means of the heat exchanger is supplied to the refrigeration unit via the low-temperature loop. In the heat exchanger, the recycled cold water is cooled, or heat is withdrawn, and it is fed back into the feed line. The heat energy withdrawn in the heat exchanger is released to the low-temperature loop. This brings the energy into the evaporator, thereby evaporating the refrigerant in the refrigeration loop of the refrigeration unit, and this is then supplied as gas to the compressor.

Preferably, the desired temperature of the cooled cold water is controlled via the volumetric flow rate of the low-temperature loop and/or of the high-temperature loop, and/or of the cold water circuit. Since individually controllable pumps are arranged in the circuits, the volumetric flow rate of the circuits can be individually controlled. Preferably, the volumetric flow rates are controlled via a controller or the controller measures the temperatures in the feed line and/in the return line of the cooled cold water and of the heat store and controls the speed of the pumps on the basis thereof.

For complete control and system monitoring, the following temperatures can be measured: cold water outlet temperature, cold water return temperature, low-temperature loop feed line, low-temperature loop return line, heat store temperature, high-temperature loop feed line and/or high-temperature loop return line.

It has been shown to be advantageous if, in the method of the invention, the pump in the cold water line system controls the cold water circulation volumetric flow rate depending on temperature on the basis of the prevailing temperature of the cold water. Preferably, this is accomplished by arranging and using at least one temperature sensor in the main feed line and/or main return line. Moreover, it has been shown to be advantageous for the temperature sensor to be arranged on the main feed line preferably after the connection to the public water supply network, thereby immediately also taking into account the temperature of the newly fed-in cold water.

Preferably, the pump controls the cold water circulation volumetric flow rate in the cold water line system with multiple cold water return lines via differential pressure, depending on the opening state of the temperature-controlled circulation valves. This allows optimal adjustment of the volumetric flow rate and allows rapid reduction of the temperature of the cold water.

It is advantageous if the drinking water supply system including heat store with heat recovery and cold water cooling and the components thereof are controlled and monitored by means of a controller.

All possible configurations are freely combinable with one another and the features of the drinking water supply system are also automatically applicable to the method and vice versa.

BRIEF DESCRIPTION OF THE DRAWINGS

Exemplary embodiments of the invention will be described with reference to the figures, wherein the invention is not limited to just the exemplary embodiments. In the figure.

DESCRIPTION OF THE PREFERRED EMBODIMENTS OF THE INVENTION

Figure 1:
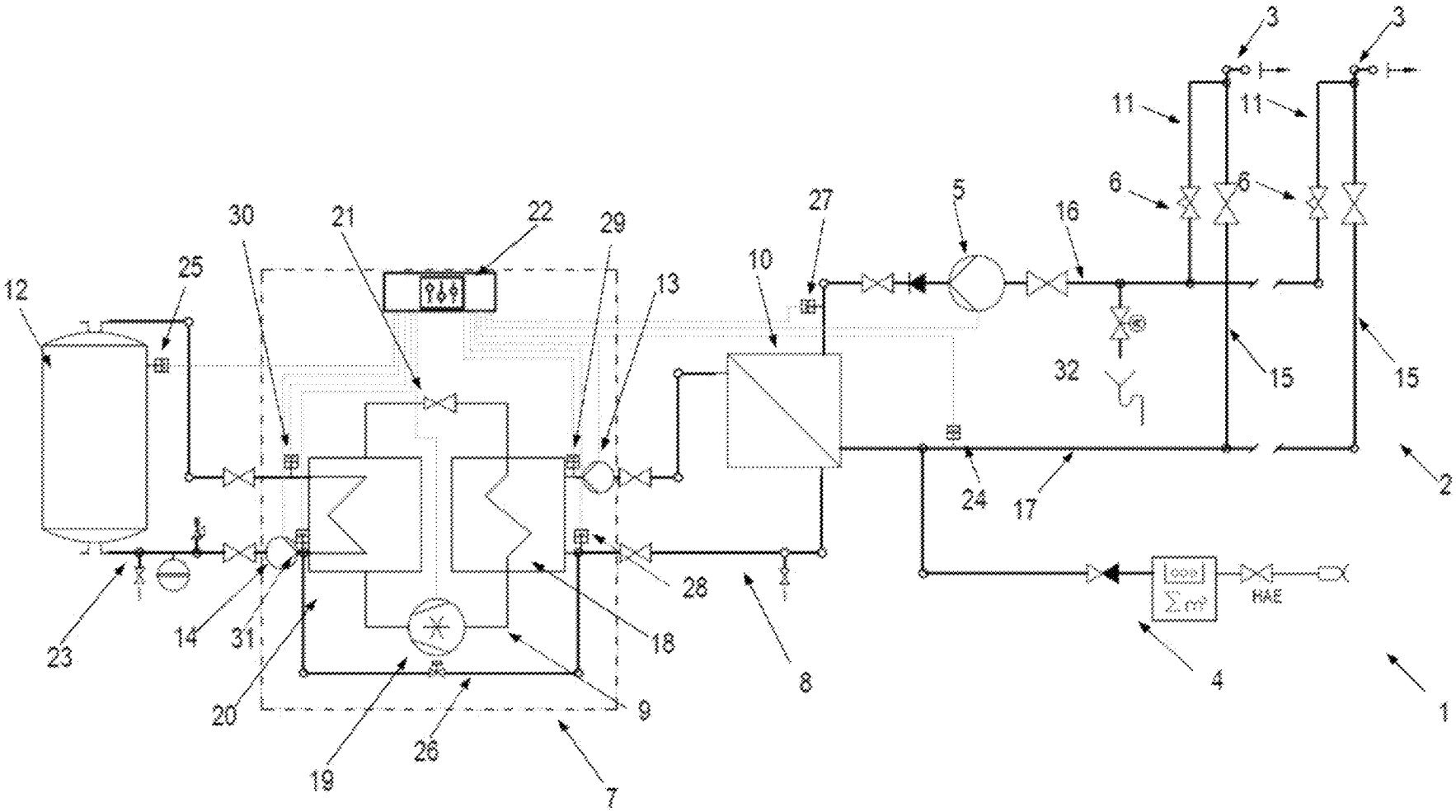
FIG. 1 shows a diagram of the drinking water supply system of the invention with circulation cooling with the connection for the public water supply network at the main feed line and FIG. 2 shows a diagram of the drinking water supply system of the invention with circulation cooling with the connection for the public water supply network at the main return line.
Figure 2:
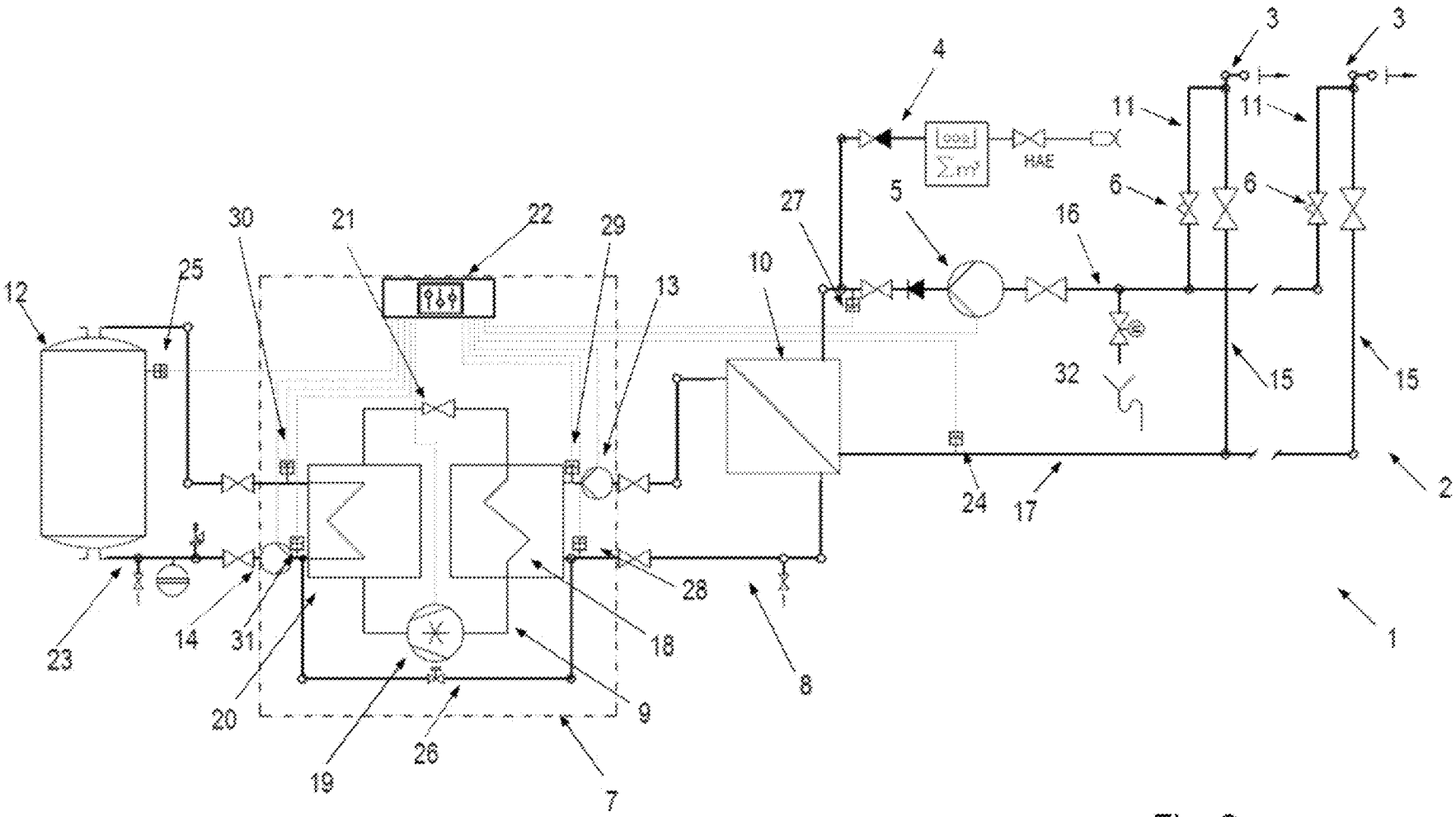

The diagram shown in FIG. 1 shows the drinking water supply system 1 of the invention with circulation cooling. The drinking water supply system 1 of the invention comprises a cold water line system 2 with at least one consumer 3 arranged thereon and a connection 4 to the public water supply network, said connection being arranged on the main feed line 17 in FIG. 1 and, as an alternative, on the main return line 16 in FIG. 2. The cold water line system 2 preferably comprises a main feed line 17 and subsequent feed lines 15 which guide the cold water to the consumer 3.

The return line 11, which preferably opens into a main return line 16, returns the unused cold water. Moreover, arranged in the cold water line system 2 is a pump 5 which controls the volumetric flow rate depending on the circulation valves 6, if the cold water system comprises multiple return lines. In the case of only one return line, a circulation valve is preferably dispensed with, since there is no need for hydraulic balancing. The circulation valve 6 is preferably temperature-controlled and arranged in the return lines 11. If the temperature in the cold water return line 11 rises, the valve 6 opens to a greater extent in order to increase the flow rate with the aid of the pump 5. For hygiene reasons, it is advantageous if a minimum volumetric flow rate set in the circulation valves ensures that stagnation is avoided. Moreover, the circulation valve 6 serves for hydraulic balancing in the cold water line system 2. If, in the cold water line system 2, the consumer(s) 3 should only be supplied via one line, as already mentioned above, the circulation valve can be dispensed with, and the temperature control and the minimum volumetric flow rate is controlled by a suitable pump 5, which is determined on the basis of the cold water temperature at at least one of the temperature sensors 24, 27. The drinking water supply system 1 moreover comprises a heat exchanger 10 which connects to the return line or the main return line 16. Heat energy is withdrawn there from the heated cold water and fed back into the feed line 17. The connection 4 for the public water supply network also connects to the main feed line 17, according to FIG. 1. The heat exchanger 10 is coupled to the refrigeration unit 7 such that the heat energy withdrawn from the heated cold water is transferred to the refrigeration unit 7. To this end, the primary low-temperature loop 8 is connected to the heat exchanger 10 such that the heat energy withdrawn from the heated cold water is transferred to, or heats, the energy carrier medium of the low-temperature loop 8. Preferably, the energy carrier medium usually used is heating water in the low-temperature loop 8. The heated energy carrier medium of the low-temperature loop 8 then serves to supply heat in the evaporator 18 of the refrigeration loop 9 in order to heat the refrigerant until it evaporates and is supplied as gas to the compressor. The refrigerant compressed in the compressor 19 with a resultant increase in temperature level is passed into the condenser 20, where it condenses by releasing heat to high-temperature loop 23. The condensed refrigerant then flows back into the evaporator 18 through the expansion valve 21 and the circuit starts again. The high-temperature loop 23 heated by the condenser releases the absorbed heat energy to the heat store 12. It has been shown to be advantageous if the pump 13 in the low-temperature loop 8 and the pump 14 in the high-temperature loop 23 are individually controllable. Preferably, the speed of the pumps is set according to the desired cold water temperature downstream of the heat exchanger 10. It is advantageous if a controller 22 monitors the temperatures of the temperature sensors 24, 25, 27, 28, 29, 30, 31 and accordingly controls the pumps 5, 13, 14 in the circuits variably in relation to volumetric flow rate.

It has also been shown to be advantageous if the high temperature loop 23 is connected to a pre-existing heating system. It is also possible, by means of a pressure equalization line 26 between low-temperature loop 8 and high-temperature loop 23, to dispense with additional safety mechanisms in the low-temperature loop 8.

The invention claimed is:

1. A drinking water supply system with circulation cooling comprising a cold water line system with at least one consumer arranged thereon, a connection to a public water supply network, a pump for producing a volumetric flow rate in a cold water circuit in the cold water line system, and at least one cold water return line and also a refrigeration unit, wherein the drinking water supply system comprises a primary low-temperature loop and a secondary high-temperature loop, wherein the refrigeration unit is connected to the primary low-temperature loop and the secondary high-temperature loop, wherein arranged in the cold water line system for cooling of the cold water is a heat exchanger which withdraws heat energy from the cold water and is coupled to the refrigeration unit such that the heat exchanger releases or transfers the heat energy of the cold water to the refrigeration unit by the primary low-temperature loop and the refrigeration unit, with the high temperature loop being configured to utilize the withdrawn heat energy from the refrigeration unit.

2. A drinking water supply system according to claim 1, wherein the heat exchanger is connected to a return line of the cold water and the cold water is passed to the heat exchanger via the return line, wherein the heat exchanger cools the cold water to a hygienically optimal temperature and feeds it back into the cold water line system.

3. A drinking water supply system according to claim 1, wherein the pump controls the volumetric flow rate in the cold water circuit variably depending on temperature or differential pressure.

4. A drinking water supply system according to claim 1, wherein in the case of multiple return lines in the cold water line system, circulation control valves are arranged in the return lines for hydraulic balancing of the cold water line system.

5. A drinking water supply system according to claim 1, wherein the refrigeration unit transfers the heat energy to a heat store.

6. A drinking water supply system according to claim 1, wherein the refrigeration unit comprises a pump for the primary low-temperature loop.

7. A drinking water supply system according to claim 1, wherein the refrigeration unit comprises a pump for the secondary high-temperature loop.

8. A drinking water supply system according to claim 1, wherein the refrigeration unit comprises an evaporator, a condenser, a compressor and an expansion valve.

9. A drinking water supply system according to claim 1, wherein a flush valve is integrated in the cold water system, wherein the flush valve serves to ensure proper water exchange.

10. A method for operating the drinking water supply system according to claim 1, wherein the heat energy withdrawn from the cold water by means of the heat exchanger is supplied to the refrigeration unit via the low-temperature loop.

11. The method according to claim 10, wherein the desired temperature of the cooled cold water is controlled via the volumetric flow rate of the low-temperature loop and/or of the high-temperature loop, and/or of the cold water circuit.

12. The method according to claim 10, wherein the pump in the cold water line system controls the cold water circulation volumetric flow rate depending on temperature on the basis of the prevailing temperature of the cold water at least one temperature sensor in the cold water line system.

13. The method according to claim 10, wherein the pump controls the cold water volumetric flow rate in the cold water line system with multiple cold water return lines according to differential pressure, depending on the opening state of the temperature-controlled circulation valves.

14. The method according to claim 10, wherein the drinking water supply system is controlled and monitored by means of a controller.

* * * * *